US008343384B2

(12) United States Patent
Cho et al.

(10) Patent No.: US 8,343,384 B2
(45) **Date of Patent: *Jan. 1, 2013**

(54) COMPOSITION FOR ELECTRODES COMPRISING ALUMINUM POWDER HAVING CONTROLLED PARTICLE SIZE DISTRIBUTION AND SIZE, AND ELECTRODES MADE USING THE SAME

(75) Inventors: Jae Hwi Cho, Uiwang-si (KR); Kuninori Okamoto, Uiwang-si (KR); Yong Hyun Kim, Uiwang-si (KR); Hyun Don Kim, Uiwang-si (KR)

(73) Assignee: Cheil Industries Inc., Gumi-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/186,537

(22) Filed: Jul. 20, 2011

(65) Prior Publication Data

US 2011/0273086 A1 Nov. 10, 2011

Related U.S. Application Data

(63) Continuation of application No. 12/275,274, filed on Nov. 21, 2008, now Pat. No. 8,043,532.

(30) Foreign Application Priority Data

Nov. 22, 2007 (KR) ..... 10-2007-0119523
May 6, 2008 (KR) ..... 10-2008-0042029
Sep. 2, 2008 (KR) ..... 10-2008-0086507

(51) Int. Cl.
*H01B 1/22* (2006.01)

(52) U.S. Cl. ..... 252/512; 252/500; 252/182.1; 429/523; 313/311

(58) Field of Classification Search ..... 252/500, 252/501.1, 512, 182.1; 429/523; 313/311, 313/325; 430/270.1
See application file for complete search history.

(56) References Cited

U.S. PATENT DOCUMENTS

2005/0287472 A1 12/2005 Lee et al.
2009/0134767 A1 5/2009 Cho et al.
2010/0252095 A1 10/2010 Senda et al.

*Primary Examiner* — Mark Kopec
*Assistant Examiner* — Haidung Nguyen
(74) *Attorney, Agent, or Firm* — Summa, Additon & Ashe, P.A.

(57) ABSTRACT

Disclosed herein is a composition for electrodes that enables a firing process in air at a temperature of 600° C. or less and does not cause an increase in absolute resistance and a substantial variation of the resistance even when the composition is repeatedly subjected to the firing process. The composition for electrodes comprises: about 5 to about 95% by weight of aluminum powder, the aluminum powder having a particle size distribution of about 2.0 or less as expressed by the following Equation (1) and having D50 in the range of about 0.1 μm≦D50≦about 20 μm; about 3 to about 60% by weight of an organic binder; and the balance of a solvent:

$$\text{Particle size distribution}=(D90-D10)/D50 \quad (1)$$

wherein D10, D50, and D90 represent particle diameters at 10%, 50% and 90% points on an accumulation curve of a particle size distribution when the total weight is 100%.

An electrode and a PDP fabricated using the composition are also disclosed.

19 Claims, 1 Drawing Sheet

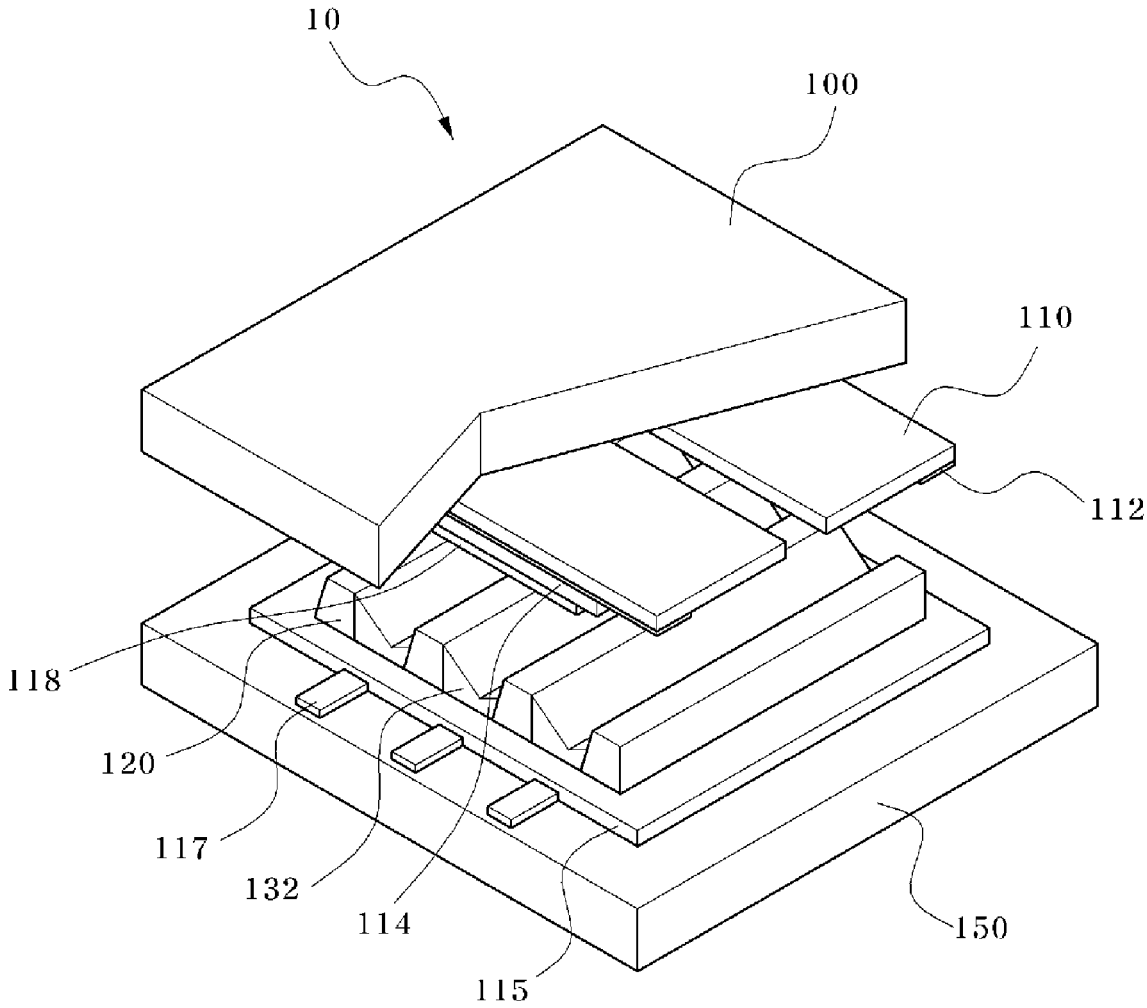
10
100
110
112
118
120
117
132
114
115
150

COMPOSITION FOR ELECTRODES COMPRISING ALUMINUM POWDER HAVING CONTROLLED PARTICLE SIZE DISTRIBUTION AND SIZE, AND ELECTRODES MADE USING THE SAME

CROSS-REFERENCE TO RELATED APPLICATIONS

This application is a continuation of U.S. application Ser. No. 12/275,274, filed Nov. 21, 2008, the entire disclosure of which is hereby incorporated by reference, and claims priority under 35 USC Section 119 from Korean Patent Application No. 10-2007-0119523, filed Nov. 22, 2007; Korean Patent Application No. 10-2008-0042029, filed May 6, 2008; and Korean Patent Application No. 10-2008-0086507, filed Sep. 2, 2008, the entire disclosure of each of which is also hereby incorporated by reference.

FIELD OF THE INVENTION

The present invention relates to a composition for electrodes and electrodes made using the same.

BACKGROUND OF THE INVENTION

For elements such as resistors, ceramic condensers, thermistors, varistors, plasma display panels, and the like, electrodes are generally formed of compositions comprising silver powder as a conductive filler using a firing process after patterning via screen printing, off-set printing, photolithography or the like.

However, using silver powder as the conductive filler in the formation of the composition for electrodes can increase manufacturing costs. Using silver as the conductive filler can also cause electrical shorts between adjacent electrodes in an electrode pattern formed of the silver powder due to migration of silver components caused by movement of electrons. This, in turn, can deteriorate the reliability of the electrodes.

To solve these problems, there have been attempts to develop cheaper conductive filler materials that can replace silver powder.

One conductive filler material employs aluminum as the conductive filler. Aluminum, however, is oxidized during the firing process in air, causing a rapid decrease in electrical conductivity of electrodes made from a composition which contains aluminum filler.

Further, because the firing process is generally repeated in the formation of the electrodes using the composition, the use of aluminum as the conductive filler results in a rapid decrease of electrical conductivity since the degree of oxidation of aluminum increases with each firing process.

To solve these problems relating to the use of aluminum as the conductive filler, the use of a spherical powder comprising aluminum or aluminum alloys has been proposed. However, the use of the spherical powder results in a high resistance of an electrode several thousand times that of the electrode formed using the silver powder and causes an increase of 10% or more in resistance of the electrode in each firing process. Thus, the spherical powder comprising aluminum or aluminum alloys have not been practical for producing electrodes.

SUMMARY OF THE INVENTION

The present invention provides a composition for electrodes that enables a firing process in air at a temperature of about 600° C. or less and does not cause an increase in absolute resistance and a substantial variation of the resistance even when the composition is repeatedly subjected to the firing process.

In accordance with an aspect of the present invention, a composition for electrodes comprises: about 5 to about 95% by weight of aluminum powder, the aluminum powder having a particle size distribution of about 2.0 or less as expressed by the following Equation (1) and having D50 in the range of about 0.1 μm≦D50≦about 20 μm; about 3 to about 60% by weight of an organic binder; and the balance of a solvent:

$$\text{Particle size distribution}=(D90-D10)/D50 \quad (1)$$

wherein D10, D50, and D90 represent particle diameters at 10%, 50% and 90% points on an accumulation curve of a particle size distribution when the total weight is 100%.

In accordance with other aspects of the present invention, an electrode and a PDP (plasma display panel) are fabricated using the composition.

BRIEF DESCRIPTION OF THE DRAWINGS

The above and other features and advantages of the present invention will become apparent from the following description of exemplary embodiments given in conjunction with the accompanying drawing, in which:

FIG. 1 is an exploded perspective view of a plasma display panel fabricated using a composition according to one embodiment of the present invention.

DETAILED DESCRIPTION OF THE INVENTION

The present invention now will be described more fully hereinafter in the following detailed description of the invention, in which some, but not all embodiments of the invention are described. Indeed, this invention may be embodied in many different forms and should not be construed as limited to the embodiments set forth herein; rather, these embodiments are provided so that this disclosure will satisfy applicable legal requirements.

According to one embodiment of the present invention, a composition for electrodes comprises a conductive filler, a glass frit, an organic binder, and a solvent.

The conductive filler comprises aluminum as a main component, and is in the form of a powder, specifically, in the form of a spherical powder that has a particle size distribution of about 2.0 or less as expressed by the following Equation (1) and has D50 in the range of about 0.1 μm≦D50≦about 20 μm.

$$\text{Particle size distribution}=(D90-D10)/D50 \quad (1)$$

wherein D10, D50, and D90 represent particle diameters at 10%, 50% and 90% points on an accumulation curve of a particle size distribution when the total weight is 100%.

Generally, although D10, D50, and D90 may be defined at constant values, each of D10, D50, and D90 is set to be in a predetermined range as above in this embodiment in order to express the scope of the present invention in terms of the particle size of a powdery sample. Accordingly, aluminum powder having a particle size within these ranges used as the conductive filler falls under the scope of the present invention.

When a composition prepared using the conductive filler having the particle size distribution and size as described above is used for forming electrodes, the electrodes do not undergo a significant variation in resistance even after being subjected to firing at a temperature of about 600° C. or less, followed by a refiring process.

The aluminum powder used for the conductive filler may be composed of pure aluminum or an aluminum alloy. The aluminum alloy is formed by alloying at least one element selected from silver, copper, silicon, tin, chromium, germanium, and combinations thereof with aluminum.

According to the present invention, the composition comprises about 5 to about 95% by weight conductive filler, for example about 30 to about 90% by weight conductive filler. If the content of conductive filler is less than about 5% by weight in the composition, the electrode formed using such a composition can have insufficient conductivity, and if the content of conductive filer exceeds about 95% by weight in the composition, the composition can exhibit poor adhesion and printability with respect to a substrate.

The aluminum powder used as the conductive filler is sieved such that a particle size distribution of the aluminum powder, that is, a value of (D90−D10)/D50, is about 2.0 or less, for example about 0.5 to about 1.7, with D50 being in the range of about 0.1 μm≦D50≦about 20 μm. As a result, the composition for electrodes according to this embodiment enables the firing process at a temperature of about 600° C. or less and does not cause an increase in absolute resistance and a substantial variation of the resistance even when the electrodes are repetitiously subjected to the firing process.

Generally, the particle size distribution of the aluminum powder can be measured using a particle size distribution meter or can be obtained via a scanning electronic microscopy (SEM).

According to one embodiment of the invention, the organic binder is at least one selected from celluloses, water soluble cellulose derivatives, and copolymers obtained by copolymerizing a monomer having an ethylenically unsaturated double bond, such as esters of acrylic acid (methyl acrylate, ethyl methacrylate, etc.), styrene, acrylic amide, acrylonitrile, and the like with a carboxyl group monomer such as acrylic acid, methacrylic acid, itaconic acid, and the like.

The content of the organic binder can range from about 3 to about 60% by weight, for example about 5 to about 50% by weight. If the content of the organic binder is less than about 3% by weight, the composition can suffer significantly reduced viscosity after production of pastes, or can suffer reduced adhesive force after printing or drying. If the organic binder exceeds about 60% by weight, the composition can contain too much of the organic binder to allow sufficient decomposition of the organic binder during the firing, which can increase resistance.

Further, the organic binder can have a decomposition temperature of about 350 to about 500° C., for example about 400 to about 480° C.

At the decomposition temperature in the above range, the oxidation rate of the aluminum powder may be adjusted during the firing process, so that the electrodes can have good resistance.

Further, when using a cohesive organic binder having a glass transition temperature of about 20° C. or less among the aforementioned organic binders, off-set printing of the composition can be easier.

In the composition of the present invention, the solvent serves to dissolve the organic binder and adjust viscosity of the composition, thereby enabling production of pastes that can be applied to a substrate.

The solvent may be selected from one having a boiling point of about 120° C. or more and generally used in preparation of a composition for electrodes. According to one embodiment, the solvent is at least one selected from methyl cellosolve, ethyl cellosolve, butyl cellosolve, aliphatic alcohol, α-terpineol, β-terpineol, dihydro-terpineol, ethylene glycol, diethylene glycol monomethyl ether, diethylene glycol monoethyl ether, diethylene glycol monopropyl ether, dietherethylene glycol monobutyl ether, dipropylene glycol monomethyl ether, propylene glycol monomethyl ether acetate, glycerol, butyl acetate, ethyl acetate, cyclohexanol, butyl cellosolve acetate, texanol, mineral spirits, organic acids, oleic acid, and combinations thereof.

Since an added amount of the solvent can be adjusted to easily adjust viscosity, the content of the solvent may be changed according to specific applications and may be in the range of about 1 to about 68% by weight.

In the composition of the present invention, the glass frit serves as an inorganic binder for improving adhesive force with respect to the substrate, and may be added in an amount of about 1 to about 30 parts by weight based on 100 parts by weight of the composition.

Examples of the glass frit can include without limitation metal oxide-based glass comprising one or more of PbO, $Bi_2O_3$, $SiO_2$, $B_2O_3$, $P_2O_5$, ZnO, or $Al_2O_3$, and may have a glass transition temperature Tg of about 300 to about 600° C.

If the glass frit has a glass transition temperature lower than about 300° C., shrinkage rate of the composition can increase excessively, which can enlarge edge curl of the electrodes formed using the composition. Conversely, if the glass frit has a glass transition temperature lower than about 600° C., conductive components of the composition may not be sufficiently sintered, which can increase electrode resistance.

If the added amount of the glass frit is less than about 1 part by weight, it can be difficult to achieve desired effects of the present invention. Conversely, if the added amount of the glass frit exceeds about 30 parts by weight, the amount of the conductive filler is comparatively decreased in the composition so that the electrodes formed using the composition may not achieve a desired level of conductivity.

On the other hand, for the composition prepared by adding the glass frit, the particle size distribution may be slightly increased or decreased due to influence of the glass frit when measured by means of a laser particle size distribution meter.

According to one embodiment of the invention, the composition may further comprise at least one additive selected from ultraviolet stabilizers, viscosity stabilizers, antifoaming agents, dispersing agents, leveling agents, antioxidant agents, anti-heat curing agents, and the like, and combinations thereof, if necessary, in order to improve flow and processing characteristics of the composition, and stability in manufacture thereof. These additives are well known to a person having ordinary skill in the art, and thus, detailed examples and description thereof will be omitted herein.

When forming electrodes from the composition, at least one of a dry film resistor (DFR) process, a screen printing process, an off-set printing process, a coater process, or a photolithography process may be used.

According to one embodiment of the invention, when using the photolithography process in the formation of the electrodes, the composition further comprises a photo-polymerization compound and a photo-polymerization initiator.

The photo-polymerization compound is a multi-functional monomer or oligomer used for photosensitive resins. The photo-polymerization compound suitable for use in this embodiment of the invention include without limitation at least one selected from the group consisting of, for example, ethyleneglycol diacrylate, triethyleneglycol diacrylate, 1,4-butandiol diacrylate, 1,6-hexanediol diacrylate, neopentylglycol diacrylate, pentaerythritol diacrylate, pentaerythritol triacrylate, dipentaerythritol diacrylate, dipentaerythritol triacrylate, dipentaerythritol pentacrylate, dipentaerythritol hexacrylate, bispenol A diacrylate, trimethylolpropane triacrylate, novolac epoxy acrylate, ethylene glycol dimethacrylate, diethylene glycol dimethacrylate, triethylene glycol dimethacrylate, propylene glycol dimethacrylate, 1,4-butandiol dimethacrylate, 1,6-hexanediol dimethacrylate, and the like, and combinations thereof.

The photo-polymerization compound may be added in an amount of about 0.1 to about 20 parts by weight based on 100 parts by weight of the composition. If the content of the photo-polymerization compound is below about 0.1 parts by weight, photo-polymerization can be insufficiently carried out, causing pattern omission during development. Conversely, if the content of the photo-polymerization compound exceeds about 20 parts by weight, organic materials can decompose during the firing process due to an excessive amount of multi-functional monomer or oligomer, causing an increase of the resistance.

Further, according to one embodiment of the invention, any photo-polymerization initiator can be used in preparation of the composition so long as it exhibits good photo-reactivity in the ultraviolet wavelength band of about 200 to about 400 nm. The photo-polymerization initiator may be at least one selected from the group consisting of benzophenone, acetophenone, triazine-based compounds, and the like, and combinations thereof.

The photo-polymerization initiator may be added in an amount of about 0.01 to about 10 parts by weight based on 100 parts by weight of the composition.

After patterning the composition at desired positions, the composition is subjected to primary drying at room temperature, followed by baking at a temperature of about 100 to about 200° C., so that a pattern of electrodes having a predetermined strength is formed.

Then, the pattern of electrodes are subjected to firing at about 450 to about 600° C., whereby the organic binder and the solvent are completely separated from the patterned composition while the glass frit added as the inorganic binder is melted to bind the conductive fillers.

The firing process typically is not performed once, but can be repeatedly performed, for example twice or three times, in accordance with a subsequent process for dielectrics.

FIG. 1 is an exploded perspective view of a plasma display panel (PDP) fabricated using a composition according to one embodiment of the present invention.

Referring to FIG. 1, a plasma display panel 10 is fabricated using the composition according to one embodiment of the present invention, and includes a front substrate 100 and a rear substrate 150.

In the plasma panel 10, transparent electrodes 110 are horizontally arranged on a surface of the front substrate 100 facing the rear substrate 150 and have bus electrodes 112 formed thereon. On each of the transparent electrodes 110, a first dielectric layer 114 for storing electric charges generated from the interior of the panel, and an MgO layer 118 for protecting the first dielectric layer 114 and enabling easy discharge of electrons are formed.

Further, address electrodes 117 are longitudinally formed on an upper surface of the rear substrate 150 facing the front substrate 100. A second dielectric layer 115 is formed on the upper surface of the rear substrate 150 having the address electrodes 117, and is formed with partitions 120 containing fluorescent materials 132 corresponding to red R, green G and blue B, respectively, to define pixel regions on the second dielectric layer 115.

Inert gas such as Ne+Ar, Ne+Xe, or the like is injected into a space between the front substrate 100 and the rear substrate 150, so that light is generated by a discharge phenomenon when voltage of a critical value or more is applied to the electrodes.

In such a PDP, the bus electrodes 112 and/or the address electrodes 117 are formed of the composition according to one embodiment of the present invention. Specifically, these electrodes are formed by one of a screen printing process, an off-set printing process, or a photolithography process.

According to an exemplary embodiment of the invention, when the electrodes are formed by the photolithography process, a method of forming the electrodes comprises:

applying the composition according to one embodiment of the invention to a glass substrate to form a composition layer having a thickness of about 5 to about 40 μm;

drying the applied composition layer at a temperature of about 80 to about 150° C. for about 20 to about 60 minutes;

exposing the dried composition layer to ultraviolet rays through a photomask;

removing an exposed region (positive type) or a non-exposed region (negative type) from the composition layer by development; and drying and firing the composition layer at a temperature of about 500 to about 600° C. The firing time is not specifically limited and is generally sufficient to decompose substantially all organics. In exemplary embodiments of the invention, the firing time can range from about 0.5 to about 3 hours at a temperature of about 550° C. or more, but firing times are not limited to this range.

Next, the present invention will be described with reference to examples to show that the composition according to the invention enables a firing process at a temperature of about 600° C. or less in formation of electrodes using the composition and does not cause an increase in absolute resistance and a substantial variation of the resistance even when the composition is repetitiously subjected to the firing process. Details of the present invention will be readily apparent to a person having ordinary skill in the art, and thus, a description thereof will be omitted.

1. Preparation of Aluminum Powder

Spherical aluminum powder prepared by any machine, such as a gas atomizer or a water atomizer, which can be used for preparing metal powder, is used as a starting material. Then, the starting material is sieved using a sieving machine (CISA, RP90) to prepare examples of aluminum powder having various particle size distributions (D90–D10) and D50.

Here, when using an aluminum alloy to prepare aluminum allow powder as the starting material, it is also possible to prepare the aluminum allow powder having various particle size distributions and average particle diameters.

The particle size distributions and the average particle diameters are measured by means of CILAS, a particle size distribution meter, and isopropyl alcohol is used as a dispersion solvent.

Table 1 shows particle size distributions of examples of aluminum powder prepared by the method according to one embodiment of the present invention.

TABLE 1

| | Al powder (A) | Al powder (B) | Al powder (C) | Al powder (D) | Al powder (E) | Al powder (F) | Al powder (G) | Al powder (H) | Al powder (I) | Al powder (J) |
|---|---|---|---|---|---|---|---|---|---|---|
| D10 | 1.95 | 4.72 | 5.28 | 2.15 | 2.15 | 3.93 | 5.46 | 1.86 | 1.56 | 3.07 |
| D50 | 4 | 8.15 | 9.19 | 3.52 | 3.5 | 5.78 | 7.66 | 4.53 | 5.11 | 4.06 |
| D90 | 6.5 | 12.27 | 13.06 | 5.73 | 7.82 | 14.35 | 10.74 | 8.37 | 14.63 | 11.64 |

TABLE 1-continued

| | Al powder (A) | Al powder (B) | Al powder (C) | Al powder (D) | Al powder (E) | Al powder (F) | Al powder (G) | Al powder (H) | Al powder (I) | Al powder (J) |
|---|---|---|---|---|---|---|---|---|---|---|
| D90-D10 | 4.55 | 7.55 | 7.78 | 3.58 | 5.67 | 10.42 | 5.28 | 6.51 | 13.07 | 8.57 |
| (D90-D10)/D50 | 1.138 | 0.926 | 0.847 | 1.02 | 1.62 | 1.802 | 0.69 | 1.44 | 2.558 | 2.111 |

2. Preparation of Composition for Electrodes

(1) Examples 1-8, and Comparative Examples 1 and 2

Compositions of examples illustrating the invention and comparative examples are prepared by mixing the aluminum powder prepared as the conductive filler, a glass frit (non-lead based Bi—Zn—B component, softening point of 480° C., average diameter of 1.5 μm), acrylic copolymer prepared as an organic binder (available from Geo Myung Co., Ltd., SPN #30-1, decomposition temperature of 447° C.), texanol prepared as a solvent (available from Eastman Chemical Co., Ltd.), followed by kneading with a ceramic 3-roll mill. Table 2 lists content ratios of the compositions.

(2) Examples 9 and 10

To form a pattern of electrodes through a photolithography process, compositions of other examples were prepared by mixing the same components as those of Examples 1 and 7 with different contents therefrom while further adding a photo-polymerization initiator (available from Shiba Co., Ltd., IC369) and a photo-polymerization compound (Satomer Co., Ltd., SR494) thereto, followed by kneading with a ceramic 3-roll mill. Table 3 lists content ratios of the compositions.

TABLE 2

| | (% by weight) | | | | | | | | | |
|---|---|---|---|---|---|---|---|---|---|---|
| Comp. | E1 | E2 | E3 | E4 | E5 | E6 | E7 | E8 | CE1 | CE2 |
| Al powder (A) | 57.5 | — | — | — | — | — | — | — | — | — |
| Al powder (B) | — | 57.5 | — | — | — | — | — | — | — | — |
| Al powder (C) | — | — | 57.5 | — | — | — | — | — | — | — |
| Al powder (D) | — | — | — | 57.5 | — | — | — | — | — | — |
| Al powder (E) | — | — | — | — | 57.5 | — | — | — | — | — |
| Al powder (F) | — | — | — | — | — | 57.5 | — | — | — | — |
| Al powder (G) | — | — | — | — | — | — | 57.5 | — | — | — |
| Al powder (H) | — | — | — | — | — | — | — | 57.5 | — | — |
| Al powder (I) | — | — | — | — | — | — | — | — | 57.5 | — |
| Al powder (J) | — | — | — | — | — | — | — | — | — | 57.5 |
| glass frit | 9.97 | 9.97 | 9.97 | 9.97 | 9.97 | 9.97 | 9.97 | 9.97 | 9.97 | 9.97 |
| organic binder | 19.11 | 19.11 | 19.11 | 19.11 | 19.11 | 19.11 | 19.11 | 19.11 | 19.11 | 19.11 |
| Solvent | 13.42 | 13.42 | 13.42 | 13.42 | 13.42 | 13.42 | 13.42 | 13.42 | 13.42 | 13.42 |

E: Example,
CE: Comparative Example

TABLE 3

| Components | Example 9 | Example 10 |
|---|---|---|
| Al powder (A) | 58 | — |
| Al powder (G) | — | 58 |
| Glass frit | 6.2 | 6.2 |
| Organic binder | 21 | 21 |
| Solvent | 6.3 | 6.3 |
| photo-polymerization initiator | 1.5 | 1.5 |
| photo-polymerization compound | 7 | 7 |

3. Formation of Thick Film Electrodes Using Compositions

The compositions of Examples 1 to 8 and Comparative examples 1 and 2 are applied to a 10 cm×10 cm glass substrate having a high melting point using P11210 coater available from Tester Sangyo Co., Ltd. Then, the applied compositions are dried and subjected to a baking process at a temperature of 110° C., followed by firing in a belt furnace at 560° C. for a peak holding time of 15 minutes in one and a half hours from carrying-in to carrying-out. Then, a 25 μm pattern of electrodes is formed and resistances of the electrodes are measured. Results of the measurement are listed in Table 4.

Electrodes are formed by: applying respective compositions of Examples 9 and 10 to the substrate to form a composition layer having a thickness of 25 μm; drying the applied composition layer at 110° C. for about 20 minutes; exposing the dried composition layer to ultraviolet rays through a photomask; removing an exposed region or a non-exposed region from the composition layer by development; and firing the composition layer at 560° C.

The resistances of the electrodes are measured and are listed in Table 4.

4. Measurement of Resistance Variation According to Repetitious Firing of Electrodes After measuring initial resistances of the electrodes formed using the compositions of Examples 1 to 10 and Comparative Examples 1 and 2, the pattern of electrodes is subjected to additional firing once or twice, followed by measuring variation of the resistances of the electrodes. Results of the measurement are listed in Table 4.

As can be seen from FIG. 4, the electrodes made from Examples 1 to 10 having a particle size distribution, (D90−D10)/D50, of about 2.0 or less have much lower initial resistances than those made using Comparative Examples 1 and 2.

Since Example 1 has a D50 of 4 and Comparative Example 2 has a D50 of 4.06, these examples are very similar with regard to D50. However, as can be seen from Table 4, these examples exhibit a very significant difference in initial resistance and post-refiring resistance according to the particle size distribution.

Further, for Example 6, when (D90−D10)/D50 exceeds 1.7, the resistance variation according to the repetitious firing is greater than the electrodes made from the compositions having (D90−D10)/D50 of 1.7 or less.

As a result, the examples demonstrate that a lower initial resistance and an insignificant variation in resistance even after firing and repeated firing can be obtained only by both adjusting D50 of the aluminum powder used as the conductive filler, and also adjusting the particle size distribution, i.e., (D90−D10)/D50, to be lower than about 2.0 or less, in accordance with the present invention.

Many modifications and other embodiments of the invention will come to mind to one skilled in the art to which this invention pertains having the benefit of the teachings presented in the foregoing descriptions. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation, the scope of the invention being defined in the claims.

What is claimed is:

1. A composition for electrodes, comprising:

about 5 to about 95% by weight of aluminum powder, the aluminum powder having a particle size distribution of about 2.0 or less as expressed by the following Equation (1)

$$\text{Particle size distribution}=(D90-D10)/D50 \quad \text{Equation (1)}$$

wherein D10, D50, and D90 represent particle diameters at 10%, 50% and 90% points on an accumulation curve of a particle size distribution when the total weight is 100%,

TABLE 4

| | E1 | | E2 | | E3 | | E4 | | E5 | | E6 | |
|---|---|---|---|---|---|---|---|---|---|---|---|---|
| | R(Ω) | Δ R(%) | R(Ω) | Δ R(%) | R(Ω) | Δ R(%) | R(Ω) | Δ R(%) | R(Ω) | Δ R(%) | R(Ω) | Δ R(%) |
| PF | 0.18 | — | 0.15 | — | 0.25 | — | 0.16 | — | 0.18 | — | 0.17 | — |
| SF | 0.18 | 0 | 0.16 | 6.7 | 0.24 | −4 | 0.16 | 0 | 0.19 | 5.5 | 0.18 | 5.9 |
| TF | 0.19 | 5.5 | 0.16 | 6.7 | 0.22 | −12 | 0.16 | 0 | 0.19 | 5.5 | 0.20 | 11.8 |

| | E7 | | E8 | | E9 | | E10 | | CE1 | | CE2 | |
|---|---|---|---|---|---|---|---|---|---|---|---|---|
| | R(Ω) | Δ R(%) | R(Ω) | Δ R(%) | R(Ω) | Δ R(%) | R(Ω) | Δ R(%) | R(Ω) | Δ R(%) | R(Ω) | Δ R(%) |
| PF | 0.19 | — | 0.17 | — | 0.2 | — | 0.14 | — | 0.42 | — | 0.38 | — |
| SF | 0.21 | 10.1 | 0.18 | 5.9 | 0.22 | 10 | 0.15 | 7.1 | 0.49 | 16.7 | 0.46 | 21 |
| TF | 0.20 | 5.3 | 0.18 | 5.9 | 0.2 | 0 | 0.14 | 0 | 0.55 | 30.9 | 0.53 | 39.5 |

PF: After primary firing (560° C.),
SF: After secondary firing (560° C.),
TF: After tertiary firing (560° C.),
E: Example,
CE: Comparative Example and having D50 in the range of about 0.1 μm≦D50≦about 20 μm;

about 3 to about 60% by weight of an organic binder; and the balance of a solvent.

2. The composition according to claim 1, wherein the aluminum powder is aluminum or an aluminum alloy.

3. The composition according to claim 2, wherein the aluminum alloy is formed by alloying at least one element selected from silver, copper, silicon, tin, chromium and germanium with aluminum.

4. The composition according to claim 1, wherein the aluminum powder has a particle size distribution of about 0.5 to about 1.7 as expressed by Equation (1) and having D50 in the range of about 0.1 μm≦D50≦about 20μm.

5. The composition according to claim 1, wherein the organic binder is at least one selected from celluloses, water soluble cellulose derivatives, and copolymers obtained by copolymerizing a monomer having an ethylenically unsaturated double bond with a carboxyl group monomer.

6. The composition according to claim 5, wherein the monomer having an ethylenically unsaturated double bond comprises at least one monomer selected from esters of acrylic acid, styrene, acrylic amide and acrylonitrile and wherein the carboxyl group monomer comprises at least one carboxyl group monomer selected from acrylic acid, methacrylic acid and itaconic acid.

7. The composition according to claim 1, wherein the solvent is at least one selected from methyl cellosolve, ethyl cellosolve, butyl cellosolve, aliphatic alcohol, α-terpineol, β-terpineol, dihydro-terpineol, ethylene glycol, diethylene glycol monomethyl ether, diethylene glycol monoethyl ether, diethylene glycol monopropyl ether, dietherethylene glycol monobutyl ether, dipropylene glycol monomethyl ether, propylene glycol monomethyl ether acetate, glycerol, butyl acetate, ethyl acetate, cyclohexanol, butyl cellosolve acetate, texanol, mineral spirits, organic acids, oleic acid, and combinations thereof.

8. The composition according to claim 1, further comprising:

a glass frit in an amount of about 1 to about 30 parts by weight based on 100 parts by weight of the composition.

9. The composition according to claim 8, wherein the glass frit comprises at least one of PbO, $Bi_2O_3$, $SiO_2$, $B_2O_3$, $P_2O_5$, ZnO, Or $Al_2O_3$.

10. The composition according to claim 9, wherein the glass frit has a glass transition temperature Tg of about 300 to about 600° C.

11. The composition according to claim 1, wherein the organic binder has a decomposition temperature of about 300 to about 500° C.

12. The composition according to claim 1, further comprising:

a photo-polymerization compound in an amount of about 0.1 to about 20 parts by weight and a photo-polymerization initiator in an amount of about 0.01 to about 10 parts by weight based on 100 parts by weight of the composition.

13. The composition according to claim 1, further comprising:

at least one additive selected from antifoaming agents, leveling agents, ultraviolet stabilizers, antioxidant agents, viscosity stabilizers, dispersing agents, anti-heat curing agents, and combinations thereof.

14. An electrode formed using a process selected from a dry film resistor (DFR1 process, a coater process, a screen printing process, an off-set printing process, and a photolithography process and comprising the step of firing the composition according to claim 1 at about 450 to about 600° C.

15. An electrode formed using a photolithography process and comprising the step of firing the composition according to claim 12 at about 450 to about 600° C.

16. The composition according to claim 1, wherein the aluminum powder has a D50 of 3.5 μm to about 20 μgm.

17. The composition according to claim 16, wherein the aluminum powder has a D90 of 5.73 μm or more.

18. The composition according to claim 17, wherein the aluminum powder has a D90 of 5.73 μm to 14.63 μm.

19. The composition according to claim 18, wherein the aluminum powder has a D90 of 6.5 μm to 14.63 μm.

* * * * *

UNITED STATES PATENT AND TRADEMARK OFFICE

CERTIFICATE OF CORRECTION

PATENT NO. : 8,343,384 B2
APPLICATION NO. : 13/186537
DATED : January 1, 2013
INVENTOR(S) : Jae Hwi Cho et al.

It is certified that error appears in the above-identified patent and that said Letters Patent is hereby corrected as shown below:

In the Specification

Column 9, Line 17, reads: "having a high melting point using ~~P11210~~ coater available"
and should read: "having a high melting point using PI1210 coater available"

In the Claims

Column 12, Line 3, Claim 9, reads: "ZnO, ~~Or~~ $Al_2O_3$."
and should read: "ZnO, or $Al_2O_3$."

Column 12, Line 24, Claim 13, reads: "dry film resistor ~~(DFR1~~ process, a coater process, a screen"
and should read: "dry film resistor (DFR) process, a coater process, a screen"

Signed and Sealed this
Twentieth Day of August, 2013

Teresa Stanek Rea
*Acting Director of the United States Patent and Trademark Office*